United States Patent [19]

Land

[11] Patent Number: 4,860,826

[45] Date of Patent: Aug. 29, 1989

[54] APPARATUS FOR SEALING A TUBING STRING IN A HIGH PRESSURE WELLBORE

[76] Inventor: John L. Land, P.O. Box 1997, Hobbs, N. Mex. 88240

[21] Appl. No.: 149,389

[22] Filed: Jan. 28, 1988

[51] Int. Cl.[4] ..... E21B 19/02; E21B 33/06; E21B 34/02

[52] U.S. Cl. ..... 166/80; 166/82; 166/84; 166/85; 166/86; 166/97; 166/208; 251/1.3

[58] Field of Search ..... 166/77.5, 80, 82, 83, 166/85, 86, 88, 90, 95, 97, 76, 75.1, 377, 382, 208, 55; 251/1.3, 1.1

[56] References Cited

U.S. PATENT DOCUMENTS

| | | | |
|---|---|---|---|
| 1,753,276 | 4/1930 | Quinn et al. | 251/1.3 X |
| 1,793,094 | 2/1931 | King | 251/1.3 X |
| 1,989,429 | 1/1935 | Segelhorst et al. | 251/1.3 X |
| 2,085,119 | 6/1937 | Penick et al. | 251/1.1 X |
| 2,336,977 | 12/1943 | Beam et al. | 166/85 X |
| 2,486,308 | 10/1949 | McCray et al. | 166/86 X |
| 2,552,901 | 5/1951 | Miller | 166/86 X |
| 2,593,793 | 4/1952 | Rector | 251/1.3 X |
| 2,943,148 | 4/1960 | Allaire | 251/1.3 X |
| 4,265,424 | 5/1981 | Jones | 251/1.3 |

*Primary Examiner*—Hoang C. Dang
*Attorney, Agent, or Firm*—Marcus L. Bates

[57] ABSTRACT

Method and apparatus for hanging and sealing a tubing string in a high pressure wellbore. The invention discloses apparatus which enables the pulling of a tubing string on an injection well to be achieved without having to kill or bleed down the formation pressure. A support and flow control apparatus is provided for supporting the upper end of a tubing string that extends downhole in a cased borehole, while packing off the annulus between the tubing and the casing. The apparatus includes a tubing hanger which is connected to the upper end of the wellbore for supporting the upper end of the tubing string therefrom so that the string is in tension. The tubing hanger includes a hollow member having a boss formed thereon by which the hollow member is received in seated relationship within the support and flow control apparatus, and further includes a main body having a vertical passageway and a horizontal passageway formed therethrough in intersecting relationship respective to one another so that the two passageways are disposed perpendicularly respective to one another.

9 Claims, 4 Drawing Sheets

APPARATUS FOR SEALING A TUBING STRING IN A HIGH PRESSURE WELLBORE

BACKGROUND OF THE DISCLOSURE

Secondary recovery of hydrocarbons involves the use of an injection well into which liquid or gas is injected in order to cause the hydrocarbons to migrate away from the injection well and toward a production well. There are many wells in the United States that are undergoing secondary recovery, and some day these same wells will be subjected to tertiary recovery. It is estimated that after primary recovery has taken place more than 80 percent of the hydrocarbons are left downhole. Accordingly, it is economically expedient to inject a gas, such as $CO_2$ or flue gases; or a liquid, such as salt water, into the injection well and in a predetermined pattern of wells, thereby causing some of the remaining hydrocarbons to be forced to migrate toward the production well.

The pressure at the wellhead of the injection well is considerable, and a lot of money and time must be invested in order to achieve the desired downhole formation injection pressure and for the system to reach equilibrium. A substantial amount of this injected material is lost whenever the well is bled down.

Occasionally a tubing string of an injection well must be pulled from its casing, and it has heretofore been necessary to bleed the well down until the hydrostatic head on the well causes the wellhead pressure to become atmospheric or less, so that the tubing string can be safely pulled without the danger of causing a blowout.

Accordingly, bleeding down the well is extremely expensive and represents substantial loss in money and time, as well as upsetting the injection pattern, causing the migration of the fluid to deviate from the desired path of travel.

The present invention provides method and apparatus for hanging and sealing a tubing string in a high pressure wellbore. The present invention provides apparatus which can advantageously be used to enable the tubing string of an injection well to be pulled under high pressure, thereby avoiding the necessity of bleeding down the well prior to invention allows the removal of the production equipment and the installation of a snubbing unit to be done prior to opening the well bore into the snubbing apparatus. This enables the snubbing apparatus to be used in pulling the tubing string and subsequently used to run a string back into the wellbore; and, thereafter to enable the production equipment to be replaced so that the well is back in operation with no appreciable loss of downhole pressure.

SUMMARY OF THE INVENTION

This invention comprehends method and apparatus for hanging and sealing a tubing string in a high pressure wellbore. The invention provides a method of pulling a tubing string on a high pressure well without the necessity of bleeding the well pressure, or having to use mud or other liquids to hydraulically control the downhole pressure. In particular, the invention comprehends apparatus which enables the pulling of a tubing string on an injection well to be achieved without having to kill or bleed down the formation pressure. More specially, the invention discloses a support and flow control apparatus for supporting the upper end of a tubing string that extends downhole in a case borehole, while packing off the annulus between the tubing and the casing.

The apparatus includes a tubing hanger which is connected to the upper end of the wellbore for supporting the upper end of the tubing string therefrom so that the string is in tension. The tubing hanger includes a hollow member having a boss formed thereon by which the hollow member is received in seated relationship within a tubing support means. The apparatus further includes a main body having a vertical passageway and a horizontal passageway formed therethrough in intersecting relationship respective to one another so that the two passageways are disposed perpendicularly respective to one another. Opposed cylindrical bores are formed within the hollow member and sealingly receive opposed pistons in a reciprocating manner within the horizontal passageway. The piston members are located at opposed ends of the horizontal passageway and are forced to move toward the axial centerline of the vertical passageway and into abutting sealed engagement respective to one another. This action packs off the annulus at the upper end of the borehole so that flow can occur only through the tubing hanger and downhole through the tubing string to which the tubing hanger is connected. This construction provides an unusual support for the upper end of the tubing string.

A vertical passageway is formed jointly through the confronting faces of the pistons for receiving the hollow tubing hanger in supported relationship therein. A seat is formed jointly on each piston at the upper end of the vertical passageway and receives the boss of the tubing hanger in seated relationship therein. Seal means provided on the confronting faces of the pistons sealingly engage one another and the tubing hanger to prevent flow from a lower to an upper part of the vertical passageway, thereby precluding flow from the upper borehole annulus, through the apparatus of the invention. Flow can occur only through the tubing and tubing hanger.

A removable actuator means for reciprocating the piston members from a retracted into an extended closed position, and vice versa, is used whenever it is desired to pull the tubing from the well. At other times, the actuator means is removed from the main body of the apparatus, with a closure member being substituted therefor so that unauthorized persons cannot tamper with the wellhead except by those having skill in the art and special tools.

The method of the present invention is carried out by installing the support and flow control apparatus of the present invention on the top of the wellbore so that the injection fluid can be injected through the apparatus of the present invention, down the interior of the tubing string, and to the formation. At some time in the future, when it becomes necessary to pull the tubing string, a packer device is run downhole and set in a profile located at the lower end of the tubing string so that flow cannot occur therethrough. This is achieved by working through a lubricator with a wireline, in a manner known to those skilled in the art. Next, the interior of the tubing hanger is plugged, the lubricator removed, a blowout preventor secured to the main body, a joint of tubing stabbed into the upper end of the tubing hanger, whereupon the entire tubing string can be lifted to clear the boss from the seat, and the actuators are then employed to retract the piston members so that the full diameter of the vertical passageway is unobstructed by the support and flow control apparatus of this invention.

A primary object of the present invention is the provision of method and apparatus by which a tubing string can be removed from a high pressure borehole without killing the well.

Another object of the invention is to provide a method and apparatus for seating a tubing string in a high pressure borehole, and of replacing a tubing string in a high pressure borehole without killing the well.

A further object of this invention is the provision of a support and flow control apparatus for supporting the upper end of a tubing string that extends downhole in a borehole while packing off the annulus between the tubing and the casing, and which enables the tubing string to subsequently be pulled from the borehole without killing the well.

A still further object of this invention is provide a tubing support means that releasably engages a tubing hanger in which packs off the borehole annulus about the tubing hanger, and which can be retracted away from the tubing hanger to provide for access to the full diameter of the casing.

Another and still further object of this invention is the provision of an improved means of supporting a tubing string at the upper end thereof by engagement of the tubing string with opposed retractable members which can be retracted away from the tubing string when the string is to be removed from the borehole, and which have special provision for rendering the apparatus tamper proof when the retracting mechanism is not in use.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

DETAILED DESCRIPTION OF THE PREFERRED EMBODIMENT

Figure 1:
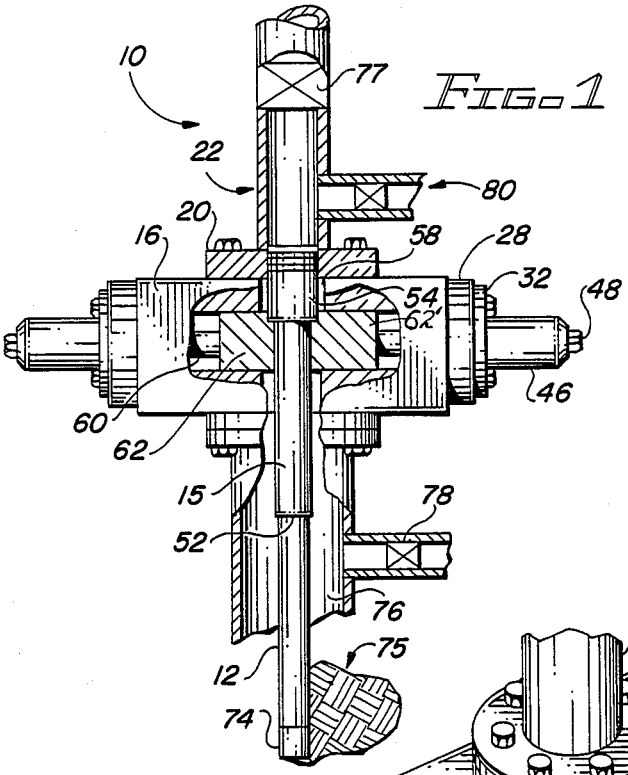
FIG. 1 is a part cross-sectional, part diagrammatical, part schematical, side elevational view of apparatus made in accordance with the present invention.

FIG. 1 of the drawings discloses an injection wellhead with the present invention being associated therewith. A casing 11 extends above the ground while a tubing string 12 extends concentrically down through the central axis of the casing. The casing terminates in flange 14. The upper terminal end of the tubing string 12 is threadedly secured to a tubing hanger 15, made in accordance with the present invention. The tubing hanger is supported within the illustrated vertical passageway formed through a main body 16 of the tubing support apparatus 10 of this invention. As seen in FIG. 2, lower flange 17 and upper flange 18 are interposed between casing flange 14 and inlet flange 20. Riser 22 can take on any number of different forms and provides a means by which fluid can flow through the main body 16 and into or out of the tubing string.

Figure 2A:
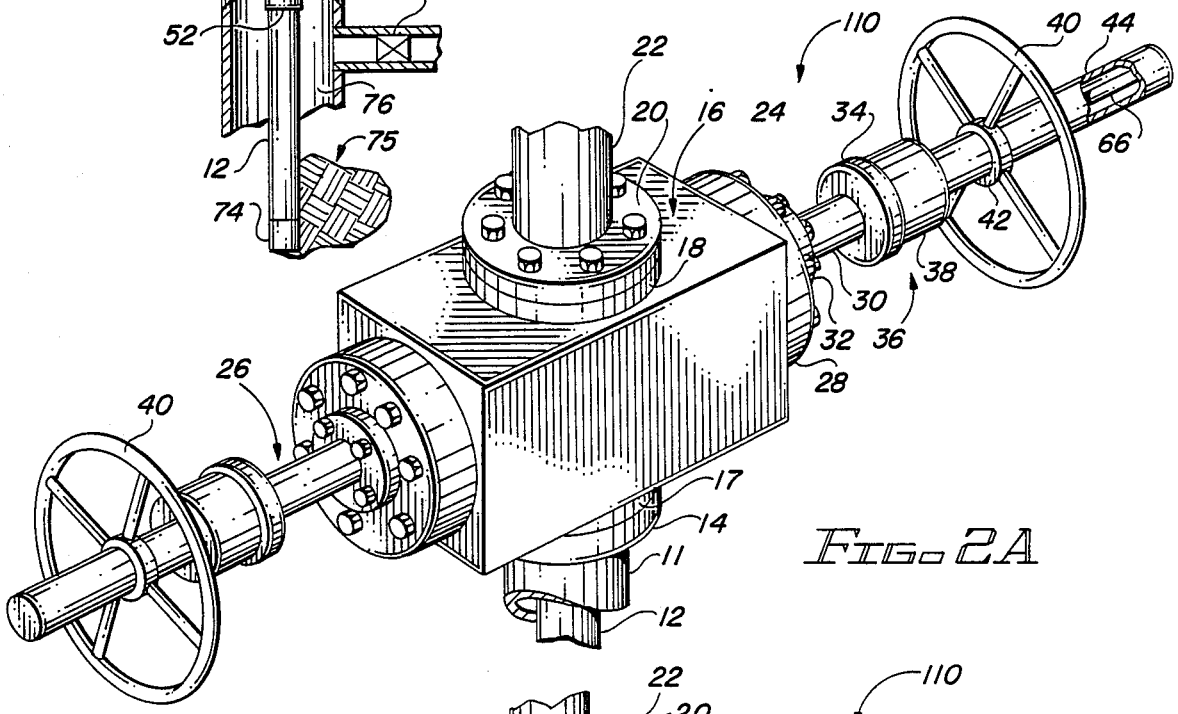
FIG. 2A is a perspective view of the apparatus disclosed in FIG. 2.
Figure 2:
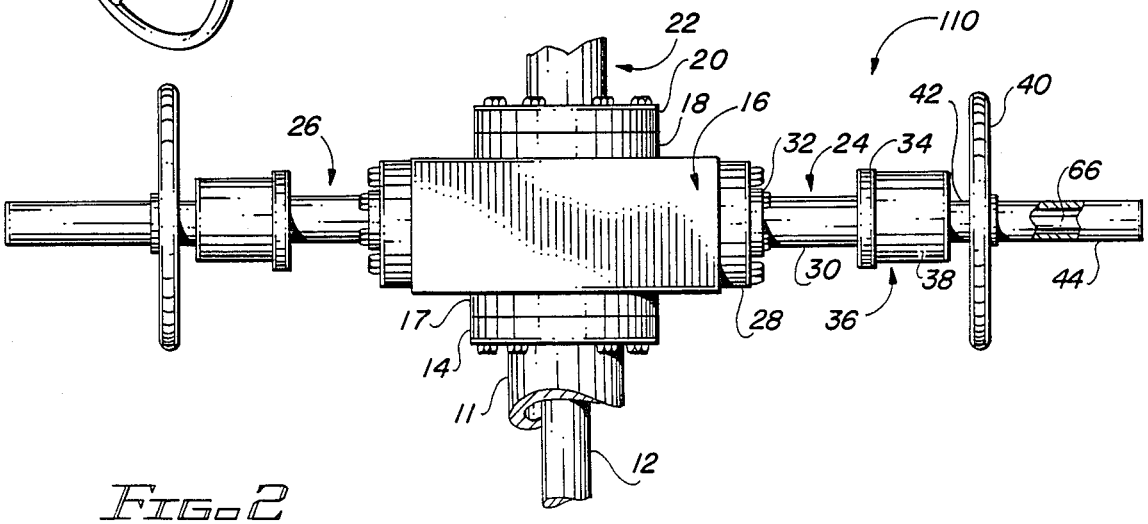
FIG. 2 is a fragmentary, side elevational view of a modification of the apparatus disclosed in FIG. 1.

In FIGS. 2 and 2A, opposed actuators 24 and 26 are attached to opposed ends of the main body 16 by means of the illustrated large diameter flanges 28. A hollow extension 30 terminates in a flange 32 at the near end thereof which is bolted to the large diameter flange 28 and spaces small outer flange 34 an appropriate distance from the main body 16. A bearing chamber 36 is removably affixed to the small diameter flange 34 and includes cylindrical wall 38. A hand wheel 40 is connected to a hollow shaft 42 which in turn is journaled within the bearing chamber 36 in a manner similar to a known bearing chamber that maybe associated with a rising stem type valve device. Protective enclosure 44 is secured to the hollow member 42.

The opposed actuators 24, 26 of FIG. 2A can be removed from large inside diameter flange 28 and a bell housing 46 substitute therefor in the manner of FIG. 1. Accordingly, FIGS. 1 and 6 illustrate the dormant configuration of the support and flow control apparatus, while FIGS. 2 and 7 illustrate the configuration of the apparatus when it is made ready for pulling tubing from a borehole.

The bell housing 46 has a flange 32 identical to the small diameter flange 32 of of FIG. 2. Bolt 48 is secured to the central axis of the bell housing 46 and bears against a connecting rod as will more fully be explained later on in this disclosure.

Figures 3, 4, 5:
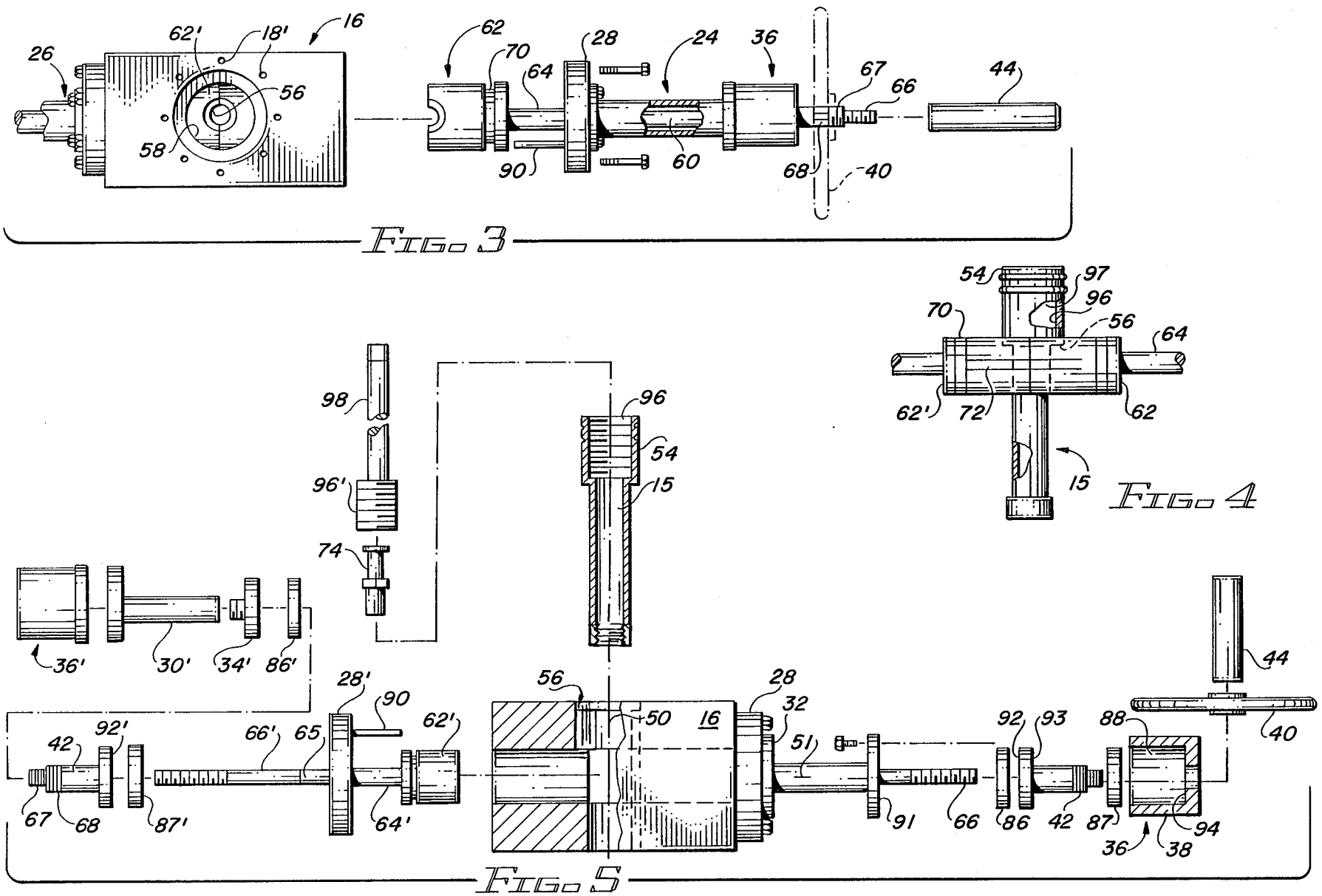
FIG. 3 is an exploded, broken, top view of the apparatus of FIG. 2.
FIG. 4 is a side view of a part of the apparatus of FIGS. 1–3, with some parts being removed therefrom and some of the remaining parts shown in cross-section.
FIG. 5 is an exploded view of the apparatus of FIG. 2, with some parts being shown in cross-section.
Figure 7:
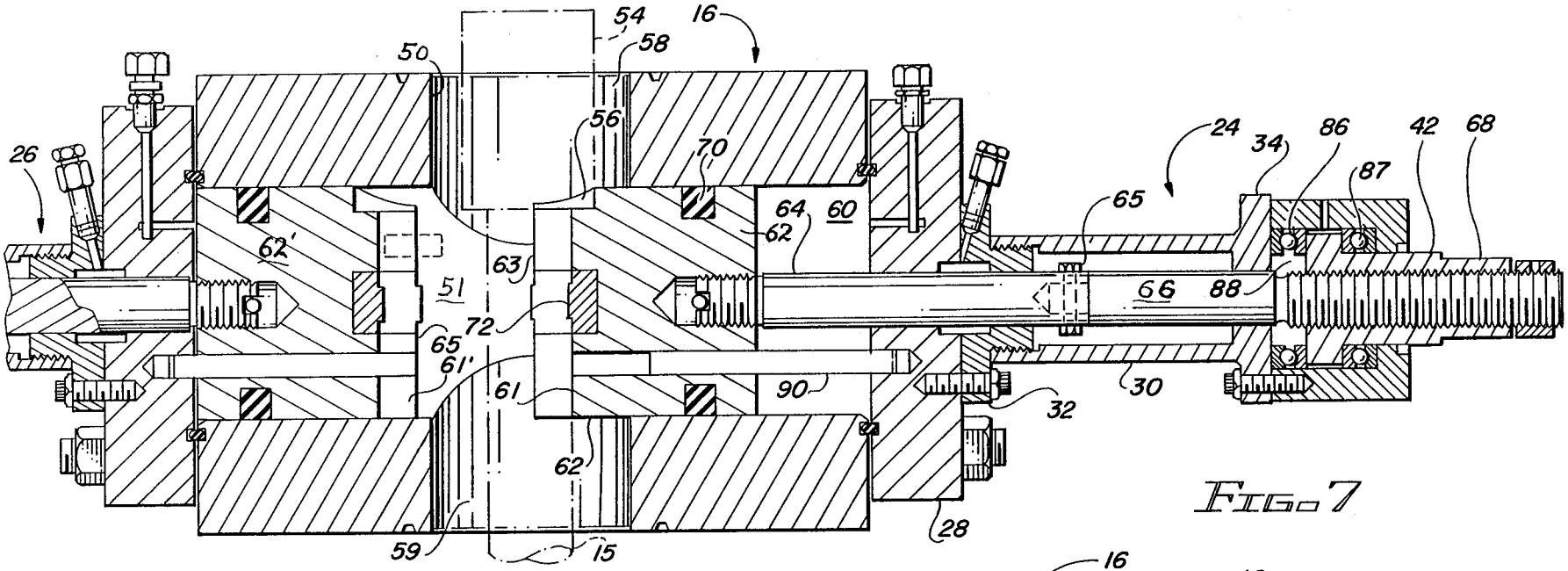
FIG. 7 is an enlarged, detailed, longitudinal cross-sectional view of the apparatus disclosed in FIG. 2.
Figure 6:
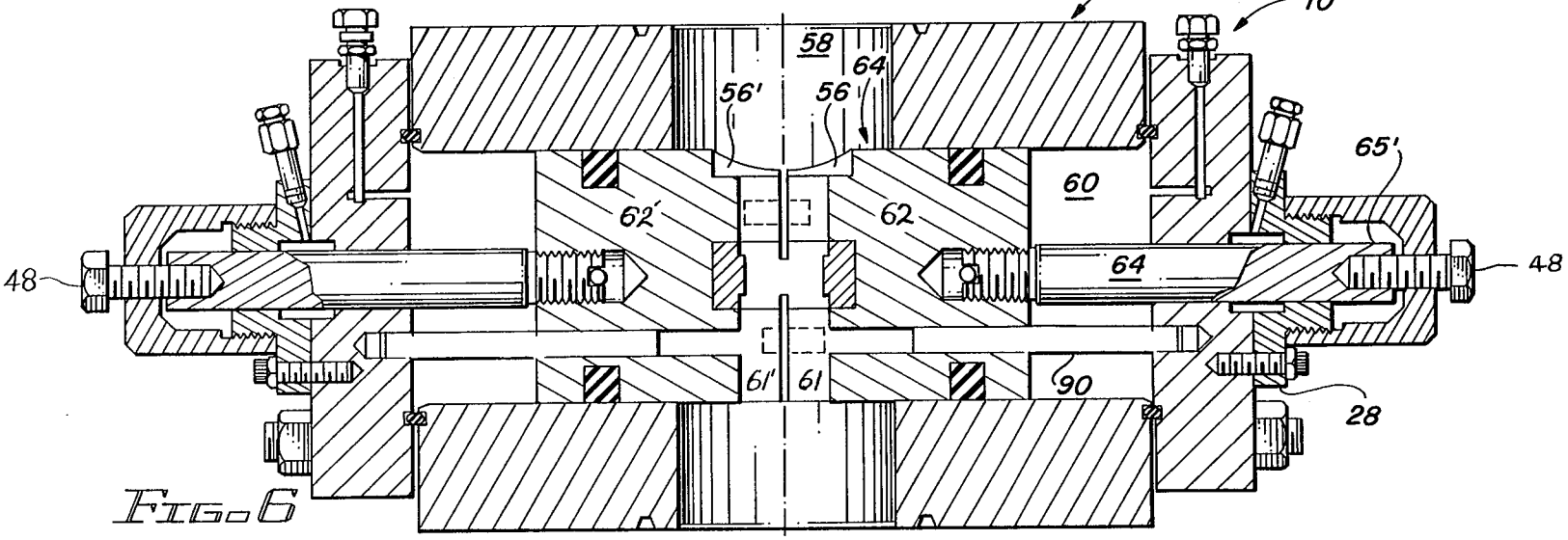
FIG. 6 is an enlarged, detailed, longitudinal cross-sectional view of the apparatus disclosed in FIG. 1.
Figure 8:
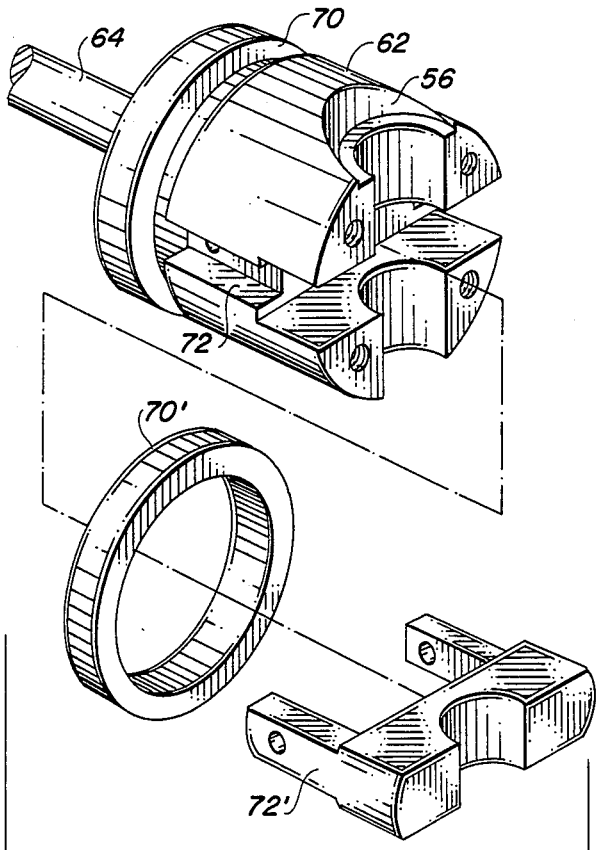
FIG. 8 is a perspective detail of part of the apparatus of FIGS. 6 and 7.
Figure 9:
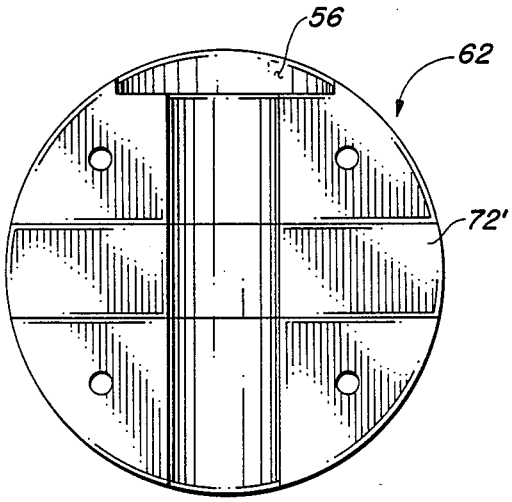
FIG. 9 is an end view of one of the parts of FIG. 8.

Vertical passageway 50 of FIGS. 5, 6, and 7 is perpendicularly arranged along the longitudinal central axis of the casing and tubing in intersecting relationship respective to a horizontal passageway 51 that lies along a horizontal axis thereof. Numeral 52 of FIG. 52 of FIG. 1 indicates a threaded connection by which the upper end of the tubing string and the lower end of the tubing hanger are attached to one another. The upper end 54 of the tubing hanger is enlarged and forms a shoulder therebetween. The shoulder is received in seated relationship on the semi-circular seat 56 formed in the upper surface of the opposed pistons 62, 62'. Opening 58 of FIGS. 6 and 7 is formed above tubing hanger 15 and the interior thereof communicates with the interior of the tubing 12. Annular area 59 of FIG. 7, located below the pistons, is separated from the upper opening 58. Operating chamber 60 forms part of the horizontal passageway 51. Numerals 61, 61' of FIG. 7 illustrates the vertical piston passageway in the face of pistons 62, 62' that receives the small diameter part of the tubing hanger 15 in sealed relationship therewithin. The pistons 62, 62' of FIG. 6 have opposed faces 63 confronting one another. The pistons are attached to piston rod 64 and the pistons can be reciprocated within the horizontal passageway 51 by the piston rod 64. Pin 65 connects the piston rod 64 and operating shaft 66 in a releasable manner to one another.

Numeral 67 of FIGS. 3 and 5 indicates a threaded end of a splined shaft 68 which receives wheel 40 thereon for rotating the hollow shaft 68 within the bearing chamber 36.

Each piston has an elastomeric packing or seal means 70 received within the illustrated groove that extends 360 degrees about a medial portion of the piston, thereby sealing the piston for sliding movement within the horizontal passageway. The piston faces are provided with U-shaped lateral packing 72' that is received within complementary recess 72 and engages opposed sides of the tubing hanger as well as one another with great force, and thereby provides a seal between the pistons and the tubing hanger. Accordingly, when the tubing hanger 15 is seated within the seat 56 that is jointly formed in the two pistons, and the two pistons have been moved with great force into abutting relationship respective to one another, the only flow that can occur through the main body is through the tubing hanger and into the interior of the tubing string 12.

Figure 10:
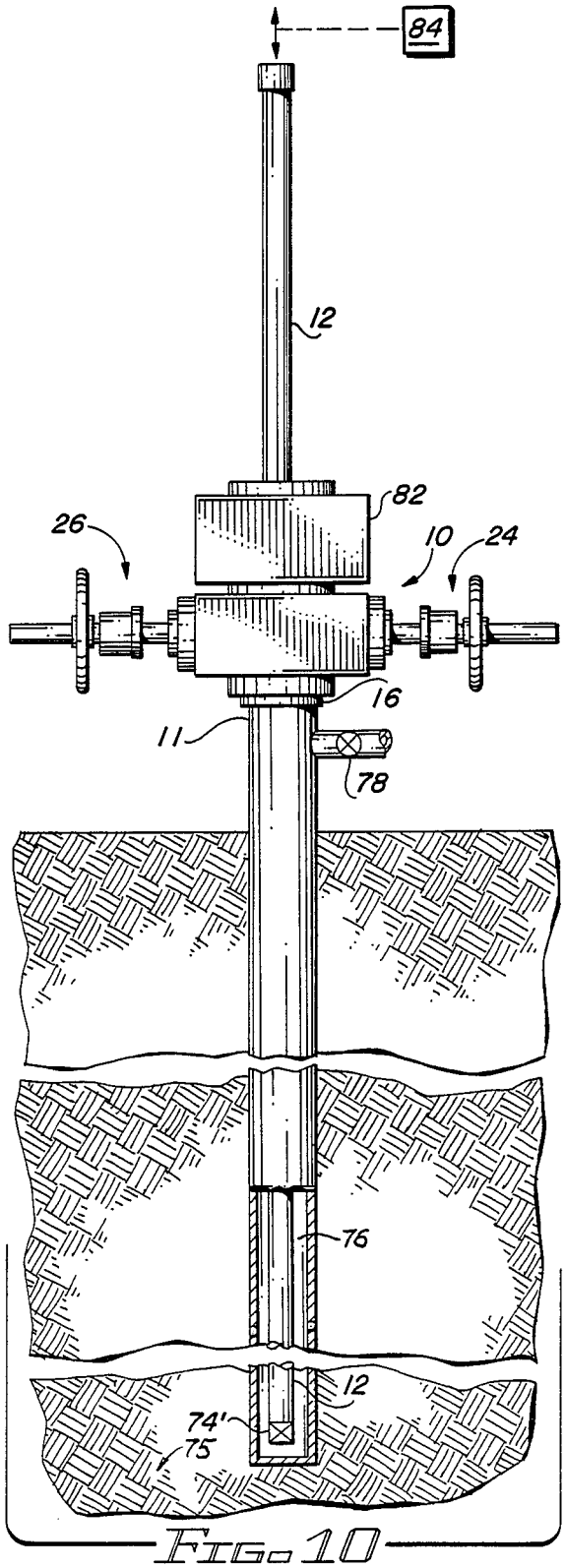
FIG. 10 is a part schematical, part diagrammatical, part cross-sectional representation of the present invention in operation.

In FIG. 10, numeral 74' indicates a profile located at the lower end of the string 12 which can receive a packer device therein for precluding flow from the formation, and up through the tubing string. The packer preferably is wireline settable respective to the profile 74'. Numeral 75 indicates the formation that receives injection fluid. Annulus 76 usually is packed off near the lower end of the tubing string so that the lower formation is isolated.

Valve 77 of FIG. 1 can be the lower valve of a lubricator, and is opened in order to gain access to the upper interior of the tubing hanger. Valve 78 enables communication with the borehole annulus. Water and the like can flow at 80.

In FIG. 10, numeral 82 diagrammatically illustrates a blowout preventor having a stripper rubber associated therewith by which the tubing 12 can be stripped from the well in a manner known to those skilled in the art of blowout preventors. Numeral 84 diagrammatically illustrates a pulling knit which is capable of pulling several joints of tubing from the borehole, and which can make-up and run a new tubing string into the borehole, as suggested by numeral 12.

In FIGS. 5 and 7 bearings 86 and 87 are received within a bearing cavity 88. Guide 90 prevents axially rotation of the piston. In FIG. 5, numeral 91 indicates a bearing retainer while numerals 92 and 93 are opposed faces of a flange which bears against bearings 86 and 87. The bearings and flange are received within the bearing housing 36. The nut 42 engages the threaded area of the shaft 66 and moves the shaft along its longitudinal axis, thereby reciprocating the piston, depending upon the direction of rotation of wheel 40, for example.

The packer device 74 of FIG. 5 is often referred to as a bridge plug and can taken on any number of different forms so long as it can be received at 74' to plug the lower end of the string 12. The tool 98 has a threaded end 96' which threadedly engages threads 96 of the tubing hanger and lifts the tubing string from the borehole. A one-way check valve can be placed at 96 in the tubing hanger 15 to permit flow down the string 12 and prevent return flow. This facilitates carrying out part of the method of the present invention.

A threaded joint in lieu of member 98 can extend into the upper threaded interior of the tubing hanger 15, and out of a lubricator, to enable a workover rig to strip the tubing from the borehole.

In operation, the apparatus 10 of the present invention is mounted on the upper end of a wellbore casing for supporting the upper end of a tubing string 12 that extends downhole in a borehole, thereby causing the annulus between the tubing and the casing to be suitably packed off or separated from one another. The apparatus includes a tubing support means 62, 62' and a tubing hanger 15.

The apparatus is installed on bolt flange 14 located at the upper end of the casing 11. The apparatus forms part of the Christmas tree and the remainder of the Christmas tree is assembled to the upper surface of the main body 16 in the manner of FIG. 1. The Christmas tree can take on all sorts of different configurations that enable it to achieve various different desirable flow paths into and out of the wellbore, FIG. 1 being a simplified Christmas tree that includes the present invention.

The pistons 62, 62' are moved toward one another by assembling the apparatus in the manner of FIG. 2, with the pistons being forced towards one another to cause the elastomeric seal thereof to flow and permanently seal the face of the pistons together and to the tubing hanger 15. The tubing hanger is now supported by the pistons 62, 62' with the tubing string being connected at 52. Flow through conduit 80 proceeds down through the tubing hanger 15, into the tubing 12, and out of the profile 74' where the flow continues through the perforated lower end of the casing and into the formation 75.

Next the opposed actuators 24, 26 are removed and the protective housings 46 substituted therefor. Accordingly, while manipulating the tubing within the wellbore the apparatus is in the configuration seen in FIGS. 2, 2A, and 7. After the tubing has been installed in the well and the injection is taking place, the apparatus is in the configuration of FIGS. 1 and 6. The apparatus may stay in the configuration of FIGS. 1 and 6 for many years and therefore the elastomeric material from which the seals are manufactured is judicially selected to provide a long lasting product.

The opposed actuators 24 and 26 have an outer shaft 66 and an inner shaft 64 connected at 65. The outer shaft 66 is removed along with the actuators 24 and 26. The bolt 48 is tightened against the remaining shaft 64 to assure to that the pistons abuttingly engage one another with a predetermined force great enough to preclude leakage across the asssembly.

When it becomes necessary to replace the tubing, the actuators 24, 26 are assembled into place by connecting shafts 64, 66 together at 65 and screwing the hollow extensions 30 into the position of FIG. 7. Thereafter, the nut 42 is rotated by the hand wheel 40 to move the shaft 64 along its longitudinal axis when it is desired to pick up on the tubing hanger and string. Prior to this, the bridge plug is placed into the profile at the end of the tubing string and the stripper assembly 82 is bolted into place at 20. It will be noted that the boss 54 of the tubing hanger has o-rings thereabout that are seated in sealed relationship respective in the flange 20. When the tubing hanger and tubing are lifted upwardly, the o-rings become unsealed respective to the flange so at this time a stripper device must be in place.

FIG. 10 shows the tubing 12 being removed from the borehole. The new string is run back into the borehole in the manner of FIG. 10, with the last joint being spaced out to place the lower end of the string at the precise desired elevation. The actuators 24, 26 are manipulated into place as the tubing hanger is seated so that the stripper device 82 can be removed from the main body 16. At this time, it is necessary to have the lower end of the string plugged with the bridge plug. The Christmas tree is reassembled, and a lubricator is used for running downhole and removing the bridge plug. The lubricator is removed and production is resumed.

Those not skilled in the art of valve devices should appreciate that rotation of nut 42 does not move the nut axially, it being captured between bearings 86, 87 contained within the bearing housing. The rotation of the nut does engage the threaded surface of the outer shaft 66 causing the shaft 66 and 64 to move axially, thereby moving the piston within the cylinder. Therefore movement of nut 42 reciprocates the piston, shaft 64, shaft 66, respective to the main housing to thereby position the piston as may be desired.

The inside diameter of the tubing hanger is as large or greater than the inside diameter of the tubing so there is no problem presented by the installation of the present invention that was not already present with the prior art wellhead. Moreover, the vertical axial passageway through the main body can be made as large as desired, as for example seen in FIGS. 6 and 7 wherein the upper and lower passageways 50 can be made of any diameter desired. Usually, it is wasted money to make the apparatus of the present invention with a vertical passageway larger than the smallest inside diameter of the casing as one proceeds downhole. This is a matter of design.

I claim:

1. Apparatus for supporting the upper end of a tubing string that extends downhole in a cased borehole while packing off an upper annulus between the tubing and the casing, comprising:

a main body having a lower surface by which said body is mounted to the upper end of a casing; a tubing hanger removably received within said main body, one end of said tubing hanger is connected to the upper end of the tubing string for supporting the tubing string therefrom; a tubing support means in said main body;

said tubing hanger is a hollow member having a boss formed thereon which forms a circumferentially extending shoulder by which the hollow member is received in seated relationship respective to the tubing support means;

said main body has a vertical passageway and a horizontal passageway formed therethrough in intersecting relationship and perpendicular respective to one another; said tubing support means includes opposed piston members sealingly received in a reciprocating manner within said horizontal passage, said piston members are located within opposed ends of said horizontal passageway and can be moved toward the axial centerline of the vertical passageway and into abutting engagement with one another;

a passageway axially aligned with said vertical passageway and formed through the confronting faces of the piston members for receiving the hollow member in supported relationship therein; a seat on each piston member which is aligned with the piston passageway for receiving the boss of the tubing hanger in seated relationship therein;

seal means on the confronting faces of each said piston member for sealingly engaging the tubing hanger and one another to prevent flow from a lower to an upper part of the vertical passageway; and, actuator means for reciprocating said piston members from a retracted open position into an extended closed position; said main body has an upper surface, an upper flange removably mounted in supported relationship on said upper surface, seal means on a marginal terminal end of said boss, the marginal terminal end of said boss is sealingly received within said upper flange whereby a stripper assembly can be connected above said flange, the interior of the boss can be engaged and lifted upwardly to thereby remove the tubing from the borehole.

2. The apparatus of claim 1 wherein said piston members are slidably sealed within said horizontal passageway and the confronting ends of the piston members sealingly engage the hollow member to prevent fluid flow across the piston members when abutting one another;

said piston members, when extended into a closed position, support said hollow member therein, and when moved to a retracted position, allow the tubing hanger and tubing string to be pulled from the borehole.

3. The support apparatus of claim 2 wherein said actuator means includes a rising stem attached to each piston member;

means for defining a bearing chamber; a stem nut threadly engaging said rising stem and by which the rising stem is axially moved when the stem nut is rotated.

4. The support apparatus of claim 3 wherein said bearing chamber and means for defining a said stem nut can be replaced with a bell housing to prevent outward movement of said piston member.

5. The apparatus of claim 1 wherein said seal means by which the confronting faces of the piston members sealingly engage one another is an elastomeric member received within a horizontal groove on the face of the piston members; said groove extends across the piston face so that when the piston members are extended into engagement with one another, the elastomer is deformed and seals the faces to one another and to the tubing hanger.

6. A combination valve and support apparatus for supporting the upper end of a tubing string that extends downhole in a borehole and for closing an upper annulus between the tubing string and the casing wall; said apparatus includes a hollow tubing hanger which has a lower end connected to a tubing string, an enlargement formed thereon that forms a shoulder by which the hollow member is received in seated relationship within a tubing support device;

a main body having perpendicular intersecting passageways formed therethrough; one passageway can be axially aligned with a borehole when the main body is affixed to the upper end of a cased borehole, leaving the other passageway horizontally disposed; said main body having a lower surface by which said body is mounted to the upper end of a casing;

opposed closure members slidably received in sealed relation within opposed marginal ends of said horizontal passageway, the confronting faces of the closure members jointly have a vertical passageway formed therethrough for receiving said hollow member therein; means on said closure members forming said tubing support device for engaging and supporting said enlargement of said tubing hanger;

seal means on the confronting faces of each closure member for sealingly engaging the tubing hanger and one another to prevent flow from a lower to an upper part of the vertical passageway;

actuator means for reciprocating said closure members from an extended into a retracted position;

said main body has an upper surface, an upper flange removably mounted in supported relationship on said upper surface, seal means on a marginal terminal end of said enlargement, the marginal terminal end of said enlargement is sealingly received within said upper flange whereby a stripper assembly can be connected above said flange, the interior of the enlargement can be engaged and lifted upwardly to thereby remove the tubing string from the borehole;

whereby; said actuator means moves said closure members into abutting engagement to support the hanger therebetween and seal the vertical passageway against flow, and fluid can flow into the interior of said tubing hanger and down the tubing string.

7. The apparatus of claim 6 wherein said vertical passageway has an inside diameter equal to the outside diameter of the tubing string so that the closure members can be retracted and the tubing string withdrawn from the borehole.

8. The apparatus of claim 6 wherein said actuator means includes a rising stem attached to actuate each closure member; means for defining a bearing chamber; a stem nut journaled within said bearing chamber and threadedly engaging the stem whereby the stem is axially moved as the stem nut is rotated, and thereby moves said closure member from a retracted into an extended position.

9. The apparatus of claim 8 wherein said seal means on each of said closure member is an elastomer; an annular groove formed about said closure member within which an annular elastomeric member is received; a U-shaped groove extending laterally across the closure member face and back along each side; a U-shaped seal member received within said U-shaped groove.

* * * * *